US006401703B1

(12) United States Patent
Mamiya et al.

(10) Patent No.: US 6,401,703 B1
(45) Date of Patent: Jun. 11, 2002

(54) METHOD AND SYSTEM FOR CONTROLLING FUEL INJECTION FOR DIRECT INJECTION-SPARK IGNITION ENGINE

(75) Inventors: Kiyotaka Mamiya; Hiroyuki Yamamoto; Keiji Araki, all of Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 1 day.

(21) Appl. No.: 09/670,700

(22) Filed: Sep. 28, 2000

(30) Foreign Application Priority Data

Sep. 30, 1999 (JP) ..... 11-278324

(51) Int. Cl.[7] ..... F02D 41/00

(52) U.S. Cl. ..... 123/674; 123/673; 123/339.12; 123/295

(58) Field of Search ..... 123/295, 339.12, 123/673, 674, 675

(56) References Cited

U.S. PATENT DOCUMENTS 5,687,699 A * 11/1997 Shimada ..... 123/673
5,950,606 A * 9/1999 Iida et al. ..... 123/672
6,122,589 A * 9/2000 Yamaguchi et al. ..... 701/106

OTHER PUBLICATIONS

Japanese Abstract: JP5099051, Date: Apr. 20, 1993.

* cited by examiner

*Primary Examiner*—Bibhu Mohanty
(74) *Attorney, Agent, or Firm*—Nixon Peabody LLP; Donald R. Studebaker

(57) ABSTRACT

A fuel injection control system for a direct injection-spark ignition type of engine forcibly turns off appliances as an external engine load while the engine operates in a stratified charge combustion mode after warming-up so as thereby to fix a quantity of intake air approximately constant and concurrently feedback controls a quantity of fuel injection according to an engine speed so as to bring the engine speed into a specified idling speed. An actual quantitative variation of fuel injection is learned on the basis of a feedback correction value of the quantity of fuel injection for each of predetermined fuel injection timings which are changed from a timing for minimum advance for best torque (MBT) so as to correspond to injection pulse widths within a region adopted for a micro-flow characteristic of the fuel injector.

11 Claims, 12 Drawing Sheets

METHOD AND SYSTEM FOR CONTROLLING FUEL INJECTION FOR DIRECT INJECTION-SPARK IGNITION ENGINE

BACKGROUND OF THE INVENTION

1. Field of the Invention

The present invention relates to a method of and system for controlling fuel injection for a direct injection-spark ignition type of internal combustion engine which is supplied with fuel directly into a combustion chamber through a fuel injector, and, more particularly, to a fuel injection control system in which learning control is performed to learn quantitative variations of fuel injection due to individual differences of fuel injectors.

2. Description of the Related Art

Typically, fuel injection control systems for general gasoline engines control an air-fuel ratio of air-fuel mixture by performing quantitative regulation of fuel injection and intake air according to engine operating conditions. In order to avoid aggravation of controllability of fuel injection due to various factors such as individual differences of fuel injectors and changes in engine operation surroundings, it is popular to perform feedback control of the amount of fuel injection on an output signal provided by an oxygen (O2) sensor disposed in an exhaust passage of the engine. In the fuel injection control, learning quantitative variations in fuel injection from the output signal of the oxygen sensor and reflecting the result in basic fuel injection control is effective to improve transient responsiveness of air-fuel ratio control and air-fuel ratio control accuracy while the feedback control of air-fuel ratio is not implemented.

Because, in a direct injection-spark ignition type of internal combustion engine which is supplied with fuel directly into a combustion chamber under high pressure, fuel is sprayed at a pressure remarkably higher as compared with port injection, quantitative variations in fuel injection are apt to be large as a logical consequence. Furthermore, an injector for the direct injection-spark ignition type of internal combustion engine has to have a relatively large nozzle, which is one of causes of large quantitative variations, In particular, a micro-flow characteristic of the fuel injector is irregular in a period of engine idling in which a time for which the injector remains open is very short differently from a period other than the idling period in which the micro-flow characteristic is linear (see FIG. 7). The micro-flow characteristics are significantly different due to individual differences of injectors. That is to say, since the injector for the direct injection-spark ignition type of internal combustion engine has the property of causing quantitative variations in fail injection while spraying a small amount of fuel, it is a reality that the direct ignition-spark ignition type of internal combustion engine has a strong demand for learning control of fuel injection for actual quantitative variations in fuel injection. However, the direct ignition-spark ignition type of internal combustion engine is usually operated in a stratified charge combustion state in an engine operating region of lower engine loads. In the stratified combustion state, a mean air-fuel ratio in a combustion chamber (which is hereafter referred to as a mean combustion chamber air-fuel ratio) is remarkably high, in other words, on a remarkably lean side, so that the oxygen sensor is hard to detect an air-fuel ratio with high precision as conventional. In consequence, although quantitative variations in fuel injection are apt to become large during idling in the lower load and stratified charge combustion region in which the engine is operate so often, it is difficult to perform the learning control of quantitative variations in fuel injection and the air-fuel ratio control accurately in that region.

In this regard, a fuel injection control system for a direct ignition-spark ignition type of internal combustion engine, such as disclosed in, for example, Japanese Unexamined Patent Publication No. 5- 99051, performs learning control of a deviation of an actual quantity of fuel injection from a target quantity of fuel injection, i.e. a quantitative variation in fuel injection, on the basis of a measurement of quantitative fuel consumption during a predetermined number of times of fuel injection while the engine is idling. In the fuel injection control, different values are employed as flow rate conversion coefficient Kps and Kpb for a regular flow characteristic of the fuel injector which is used in a proportional region where the quantity of fuel injection is proportional to a period of time for which the fuel injector is kept open (duration of injector opening) and a micro-flow characteristic of the fuel injector which is used in a non-proportional region where the quantity of fuel injection is not proportional to a period of time for which the fuel injector is kept open (duration of injector opening), respectively. For an intermediate region between the proportional and non-proportional regions, a conversion coefficient is gained by linear approximate calculation with use of the conversion coefficient Kpb and Kps.

The prior art fuel injection control system described above defines a micro-flow characteristic for the non-proportional region by a single flow rate conversion coefficient, the control of fuel injection can not be so precise in the non-proportional region. Specifically, as shown in FIG. 7 by way of example, when an injection pulse width Ti, which is a measurement of how long the fuel injector is kept open, is smaller than a specified injection pulse width Ti*, the quantity of fuel injection by the fuel injector is not proportional to the injection pulse width Ti and irregularly changes with respect to a change in injection pulse width Ti. Therefore, in the case where the micro-flow characteristic, i.e. the relationship between a quantity of fuel injection and an injection pulse width is defined by a single conversion efficiency Kps, the control of fuel injection is not precise at all in the non-proportional region. In consequence, though the prior art fuel injection control system is adapted to correct the conversion efficiency Kps by learning quantitative variations of fuel injection through a fuel injector, it can not be said that the fuel injection control is precise during engine idling where a quantity of fuel injection is small and, therefore, the prior art fuel injection control system leaves room for further improvement in regard to emission control and fuel consumption.

SUMMARY OF THE INVENTION

It is therefore an object of the present invention to provide a fuel injection control system capable of learning quantitative variations of fuel injection with high precision in a region of narrow injection pulse widths which is realized through a fully worked-out control sequence.

The foregoing object of the present invention is accomplished by a fuel injection control system which, while feedback controlling a quantity of fuel injection so as to provide a constant idling engine speed during idling, performs learning quantitative variations in fuel injection on the basis of a feedback control value for various duration of injector opening by forcibly changing a quantity of fuel injection, necessary to keep the constant idling engine speed, for a plurality of specified fuel injection timings which take place in turn.

Specifically, as shown in FIG. 1, the fuel injection control system, that is incorporated with a direct injection-spark ignition type of internal combustion engine equipped with a fuel injector 12 for spraying fuel directly into a combustion chamber 6 of the engine 1 in a compression stroke of each cylinder 2 so as to cause stratified charge combustion in a specified engine operating region of lower engine loads and lower engine speeds defined for stratified charge combustion, comprises intake air quantity regulation means 220 for regulating a quantity of intake air that is admitted into the combustion chamber 6, learning control means 52 learning a quantitative variation of an actual quantity of fuel injection from a target quantity of fuel injection while the engine idles in the specified engine operating region for stratified charge combustion, intake air flow control means 45 for controlling the intake air regulation means 220 so as to provide a constant quantity of intake air that is admitted into the combustion chamber while learning the quantitative variation, and fuel injection quantity control means 51 for feedback controlling the actual quantity of fuel injection so as to bring an engine speed ne into a specified idling engine speed while learning the quantitative variation, and ignition timing control means 50 for adopting a plurality of specified fuel injection timings in turn while learning the quantitative variation of fuel injection. The learning control means 52 implements the learning of a quantitative variation of an actual quantity of fuel injection from a target quantity of fuel injection on the basis of a feedback control value for each specified fuel injection timing.

According to the fuel injection control system, while the engine 1 idles in the specified engine operating region for stratified charge combustion, the-intake air flow control means 45 controls the intake air regulation means 220 so as to provide a constant quantity of intake air that is admitted into the combustion chamber and the fuel injection quantity control means 51 feedback controls the actual quantity of fuel injection so as to bring an engine speed ne into a specified idling engine speed. The learning control means 52 learns a quantitative variation of an actual quantity of fuel injection from a target quantity of fuel injection on the basis of a feedback control value. In consequence, the fuel injection control system performs direct learning of a quantitative variation of fuel injection during engine operation in a stratified charge combustion mode as well as during an ordinary engine idling mode. Furthermore, while learning a quantitative variation of fuel injection during engine operation in the stratified charge combustion mode, the duration o injector opening is varied so as to bring an engine speed ne into a specified idling engine speed according to the specified ignition timings that take place in turn. Since the learning control is implemented at every specified ignition timing, quantitative variations of fuel injection are obtained for different duration of injector opening.

Accordingly, even when a quantity of fuel injection does not vary in proportional to a change in duration of injector opening while the fuel injector is kept open for an extremely short period of time, it is enabled to learn the delicate relationship between duration of injector opening and an actual quantity of fuel injection, which results in having an accurate grasp of the characteristic of fuel injection of the fuel injector. This makes it possible to eliminate a quantitative variation of fuel injection even while the engine idles by determining a quantity of fuel injection on the basis of the characteristic of fuel injection of the fuel injector with an effect of significantly lowering emission levels and improving fuel consumption.

The fuel injection control system may calculates the target quantity of fuel injection according at least to an engine operating condition and controls the fuel injector to keep open for a period of time necessary for the target quantity of fuel injection according to the characteristic of fuel injection. In this instance, the characteristic of fuel injection is corrected on the basis of the learned values for the specified fuel injection timings.

The fuel injection control system may control the intake air quantity regulation means to admit intake air into the combustion chamber so as to provide a mean excess air ratio $\gamma$ equal to or greater than 1.3 while learning quantitative variations of fuel injection. Since a change in engine output relative to a change in fuel injection quantity becomes larger in a lean state where the excess air ratio $\gamma$ is equal to or greater than 1.3, the learning control of quantitative variations of fuel injection is performed with a high sensitivity. Moreover, since a change in engine output relative to a change in ignition timing becomes larger in a the lean state, it is enabled to learn quantitative variations of fuel injection over a relatively wide range of duration of injector opening even through the ignition timing is not varied so significantly. This makes it precise to learn the characteristic of fuel injection of the fuel injector.

The fuel injection control system may further calculate a charging efficiency of intake air admitted into the combustion chamber and corrects the learned value of a quantity of fuel injection on the basis of the charging efficiency of intake air. Although the accuracy of the learning control of quantitative variations of fuel injection on the basis of a learned value of a quantity of fuel injection possibly lowers due to fluctuations in engine output which occur due to a change in the charging efficiency of intake air, however, correcting the learned value of a quantity of fuel injection that is made on the basis of an actual charging efficiency of intake air yields improvement of learning accuracy.

The fuel injection control system may be configured so as to force appliances such as, for example, a compressor of an air conditioning system as an external engine load to turn off. Although the accuracy of the learning control of quantitative variations of fuel injection on the basis of a learned value of a quantity of fuel injection possibly lowers due to a change in fuel injection quantity which occurs due to a change in engine load while learning a quantitative variation of fuel injection of the fuel injector, however, forcibly turning off the appliances as an external engine load while learning a quantitative variation of fuel injection of the fuel injector yields improvement of learning accuracy.

The fuel injection control system may learn quantitative variations of fuel injection of the fuel injector after the engine warms up. There is a general tendency for the quantity of fuel injection necessary to keep an idling speed to slightly increase due to insufficient atomization and evaporation of fuel until the engine warms up. This tendency is eased as the temperature of engine raises. For this reason, besides the accuracy of the learning control of quantitative variations of fuel injection on the basis of a learned value of a quantity of fuel injection is low until the engine warms up, the learned result changes with time. In this regard, the fuel injection control system performs the learning control of quantitative variations of fuel injection after the engine warms up, so as thereby to provide the learning control of quantitative variations of fuel injection with a sufficiently high accuracy.

The fuel injection control system may further perform the learning control of quantitative variations when the engine cooling water is higher than a specified temperature even before the engine warms up as well as after the engine warms up. This increases the frequency in learning the quantitative variations in fuel injection, so as to realize high precision of the learning of quantitative variations in fuel injection. In this instance, as long as the engine is in a semi-warmed condition, a learned value is slightly inaccurate as compared with one gained after the engine warms up, but it is reliable.

The fuel injection control system may correct a learned value according to a temperature of the engine cooling water in consideration of a tendency for the quantity of fuel injection necessary to keep an idling speed to increase with a raise in the temperature of engine cooling water. This makes it possible to estimate a fuel injection characteristic for after warming up on the basis of a learned result gained during a semi-warmed state of the engine, which realizes high precision of the learning of quantitative variations in fuel injection.

The fuel injection control system is suitably incorporated in a multiple cylinder engine and, in this case, learns a quantitative variation on the basis of a mean value of the feedback control values in a specified combustion cycles by cylinder. Since this makes it possible to precisely learn a quantitative variation of fuel injection of the fuel injector for each cylinder, fuel injection for the entire engine can be controlled with high precision by correcting fuel injection characteristics of the respective fuel injections on the basis of learned results, respectively.

BRIEF DESCRIPTION OF THE DRAWINGS

The above and other objects and features of the present invention will be clearly understood from the following description with respect to the preferred embodiment thereof when considered in conjunction with the accompanying drawings, in which.

DETAILED DESCRIPTION OF THE PREFERRED EMBODIMENTS

Figure 1:
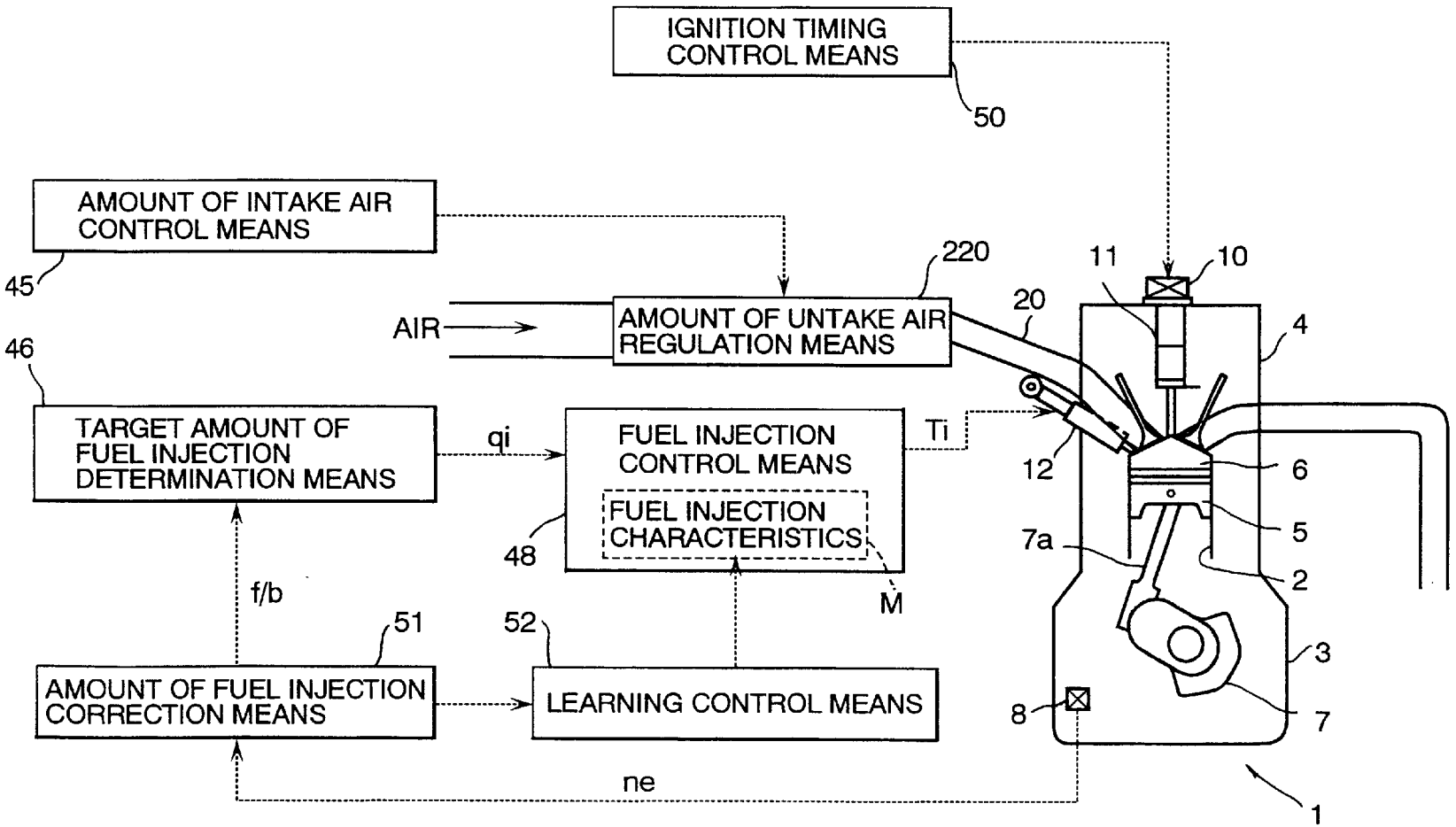
FIG. 1 is an illustration schematically showing a control system for a direct injection-spark ignition type of engine of the invention.
Figure 2:
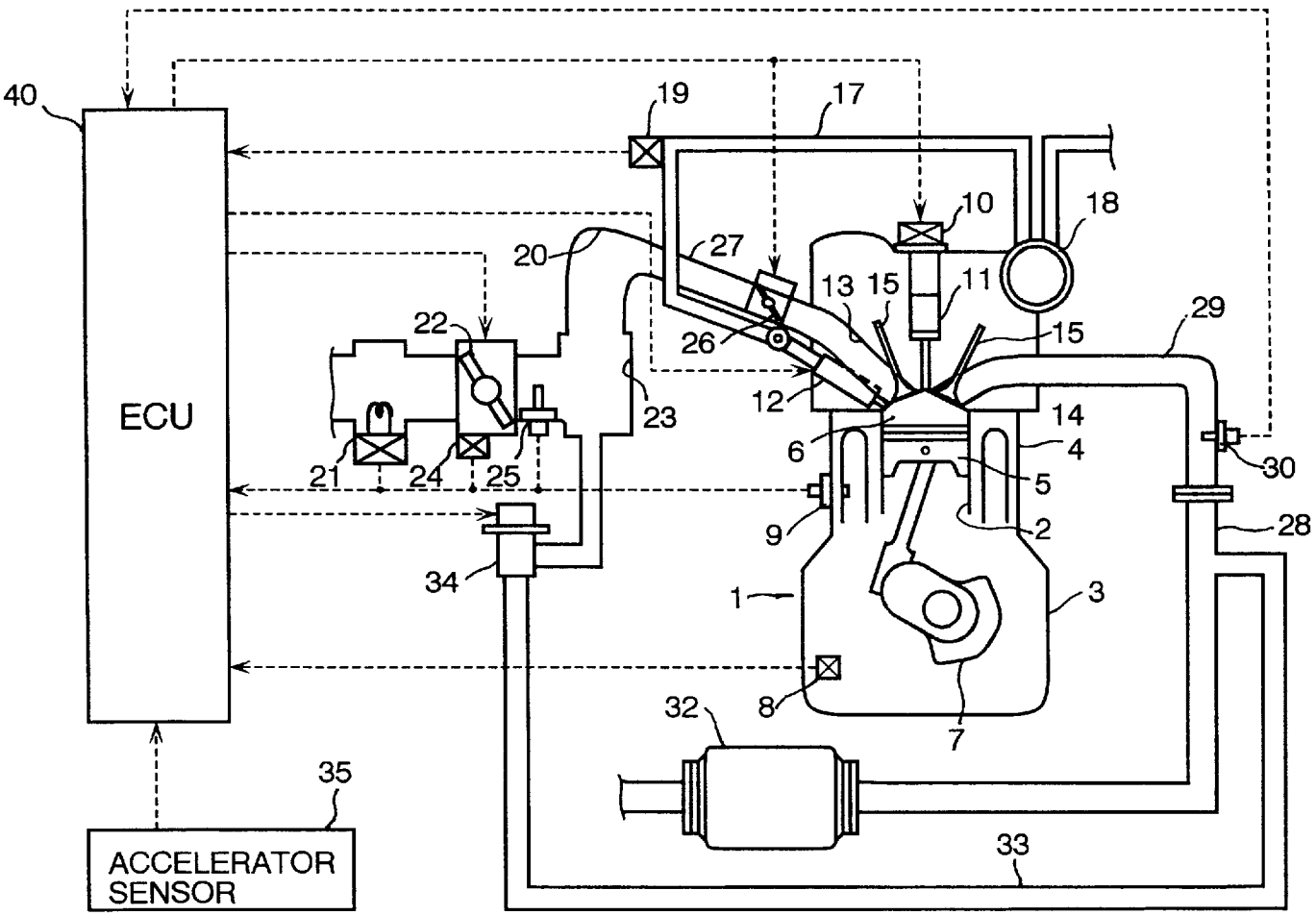
FIG. 2 is an illustration showing the overall structure of a fuel injection control system for a direct injection-spark ignition type of engine in accordance with a preferred embodiment of the invention.
Figure 3:
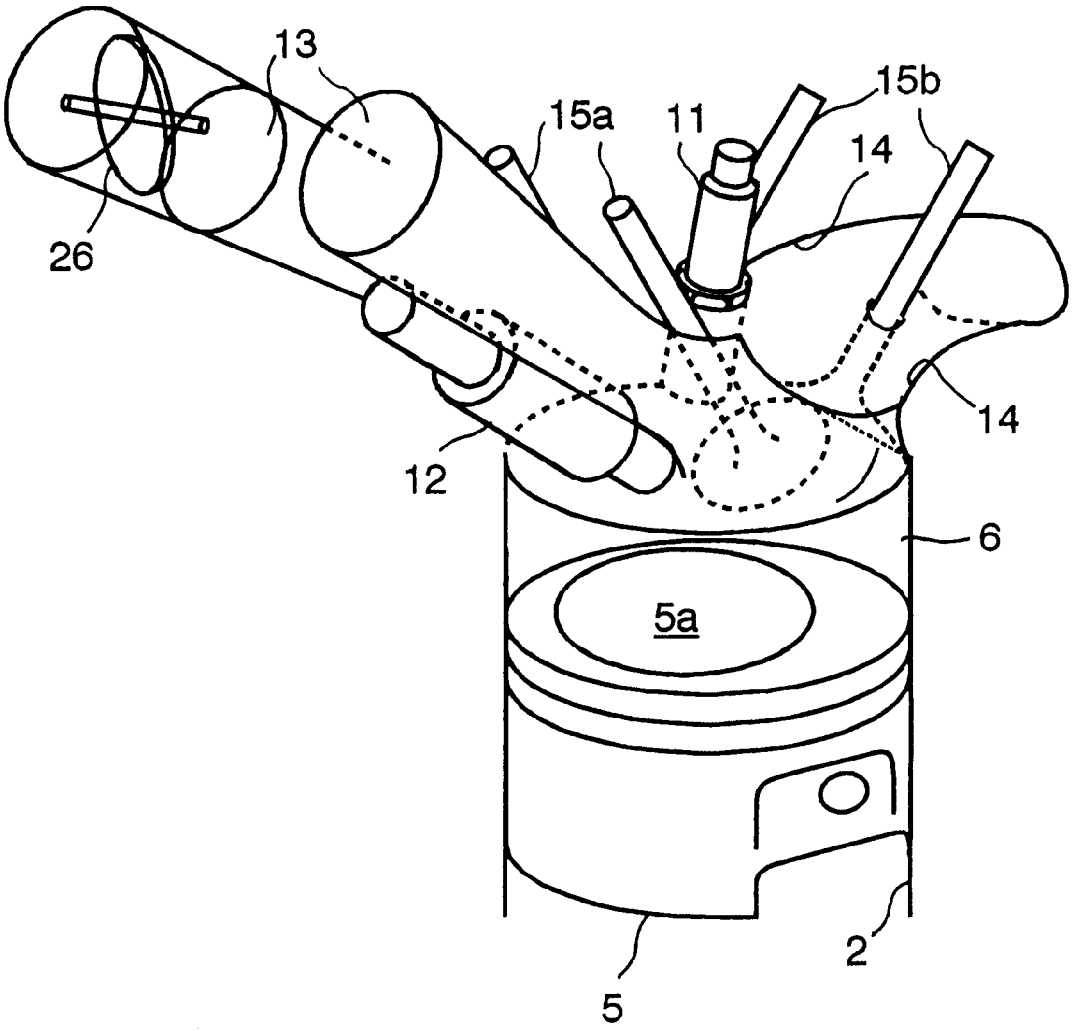
FIG. 3 is a schematic view showing a combustion chamber of the direct injection-spark ignition type of engine.

Referring to the drawings in detail, and in particular, to FIG. 2 which shows the overall structure of a fuel injection control system for a direct injection-spark ignition type of multiple cylinder gasoline engine (which is hereafter referred to as an engine for simplicity) according to a preferred embodiment of the invention, the engine 1 comprises a cylinder block 3 in which multiple cylinders 2 (only one of which is shown) are arranged in a straight line and a cylinder head 4 attached to the cylinder block 3. Pistons 5 are received in the respective cylinders 3 for up and down slide movement. A combustion chamber 6 is formed in the cylinder 2 between a bottom wall of the cylinder head 4 and a piston head of the piston 5. A crankshaft 7 is disposed below the piston 5 in the cylinder block 3 and connected to the piston 5 through a connecting rod 7*a*. The engine 1 is provided with an electromagnet type of angle sensor 8 disposed on one of opposite ends of the crankshaft 7 which monitors a rotation al angle of the crankshaft 7 and a t temperature sensor 9 which monitors a temperature of cooling water in an water jacket of the cylinder block 3. A spark plug 11 is installed in the cylinder head 4 so as to extend down in the combustion chamber 6 and connected to an ignition circuit 10. A fuel injector 12 is installed in the cylinder head 4 so as to spray fuel directly into the combustion chamber 6. As schematically shown in FIG. 3, two intake ports 13 and two exhaust ports 14 are formed for each cylinder 2 so as to open to the combustion chamber 6 and opened and closed by intake valves 15*a* and exhaust valves 15*b*, respectively. Each intake port 13 extends straight diagonally upward from the combustion chamber 6 and opens at one side of the cylinder head 4 (the left side of the cylinder head 4 as viewed in FIG. 2), Each exhaust port 13 extends substantially horizontally from the combustion chamber 6 and opens at another side of the cylinder head 4 (the right side of the cylinder head 4 as viewed in FIG. 2). The fuel injector 12 is positioned between and below the intake ports 13 so as to put its nozzle (not shown) in close proximity to valve heads of the intake heads 15*a* and adjacent to the combustion chamber 6 and sprays fuel into the combustion chamber 6 from the side through the nozzle and, on the other hand, is connected to a high pressure fuel pump 18 through a fuel supply passage 17 which is common to all of the fuel injectors 12. The high pressure fuel pump 18 cooperates with a high pressure regulator (not shown) to provide an appropriate pressure at which fuel is supplied to the fuel injector 12. A pressure sensor 19 monitors fuel pressure in the in the fuel supply passage 17. When the fuel injector 12 sprays fuel at a timing after a mid-point of a compression stroke, a fuel spray is trapped in an elliptical cavity 5*a* at the top of the piston 5 so as to form stratified charge of a fuel mixture which is relatively thick around the spark plug 11. On the other hand, when the fuel injector 12 sprays fuel at a timing in an intake stroke, a fuel spray is spread uniformly in the combustion chamber so as to form homogeneous charge of a fuel mixture.

Air is introduced into the combustion chamber 6 through an intake passage 20 extending from the intake ports 13. The intake passage 20 is equipped in order from the upstream with an air cleaner (not shown), a hot-wire type of air flow sensor 21, a throttle valve 22 and a surge tank 23. The throttle valve 22, which works as an air flow rate regulator, is not mechanically connected to an accelerator pedal (not shown) but operated by an electric motor in response to movement of the accelerator pedal. The intake passage 20 is further equipped with a valve lift sensor 24 operative to detect valve lift of the throttle valve 22 and a pressure sensor 25 operative to detect intake air pressure downstream from the throttle valve 22. The intake passage 20 at the downstream end is connected to an intake manifold 27 having two independent passages through which the intake ports 8 for each cylinder are connected to the manifold. One of each two intake ports 8 is provided with a swirl control valve 26. As shown in FIG. 3, the swirl control valve 26 comprises a butterfly valve and is driven by an actuator (not shown). When closing the swirl control valve 26, intake air is admitted through the other intake port 8 only with an effect of causing a strong swirl in the combustion chamber 6. On the other hand, as the swirl control valve 26 is gradually opened, intake air is admitted through both the intake ports 8, as a result of which a tumble component of intake air is strengthened and a swirl component of air is weakened. Exhaust gas is discharged from the combustion chamber 6 into an exhaust passage 28 which is connected to the exhaust ports 14 through an exhaust manifold 29. The exhaust manifold 29 at its integrated end is equipped with an oxygen (O2) sensor 30 operative to monitor an oxygen concentration of exhaust gas on the basis of which an air-fuel ratio is detected. A γ-O2 sensor, which provides an outputs turning over before and after a stoichiometric air-fuel ratio, is employed in this embodiment. The exhaust passage 28 at its downstream end is equipped with a catalytic converter 32 for purifying exhaust gas. The catalytic converter 32 may be of a typ which, on one hand, absorbs NOx in an excess oxygen exhaust gas (an oxygen concentration of exhaust gas is, for example, above 4%) and, on the other hand, releases NOx for deoxidization when the oxygen concentration lowers and which has, in particular, a catalytic conversion efficiency as high as three-way catalytic converters. The exhaust passage 28 at an upstream part is connected to an exhaust gas recirculation (EGR) passage 33 through which exhaust gas is partly admitted into an intake passage 22 between the throttle valve 22 and the surge tank 23 and which is equipped with an electrically operated exhaust gas recirculation (EGR) valve 34 disposed near the surge tank 23 for regulation of the amount of exhaust gas that is recirculated.

An electric control unit (ECY) 40 provides control signals for various electrical elements including the ignition circuit 10 of the spark plug 11, the fuel injector 12, electric actuators for the throttle valve 22, the swirl valve 26 and the EGR valve 34, etc. For controlling the electrically operated elements, the electric control unit 40 receives various signals, namely, at least a signal representative of a temperature of engine cooling water from at least the temperature sensor 9, a signal representative of a fuel pressure from the pressure sensor 19, a signal representative of an air flow rate from the air flow sensor 21, a signal representative of an accelerator travel from an accelerator travel sensor which is schematically shown by a reference number 35, a signal representative of a temperature of intake air from a temperature sensor (not shown) and a signal representative of an atmospheric pressure from a pressure sensor (not shown). The electric control unit (ECU) 40 controls engine output according to engine operating conditions by controlling parameters, such as an amount and a timing of fuel injection through the fuel injector 12, an amount of intake air which is regulated by the throttle valve 22, strength of a swirl which is regulated by the swirl control valve 26, an amount of exhaust gas recirculation through the EGR valve 34. By the control, the engine 1 is operated in different combustion modes as a result of switching a form of fuel injection of the fuel injector 12 according to engine operating conditions.

Figure 4:
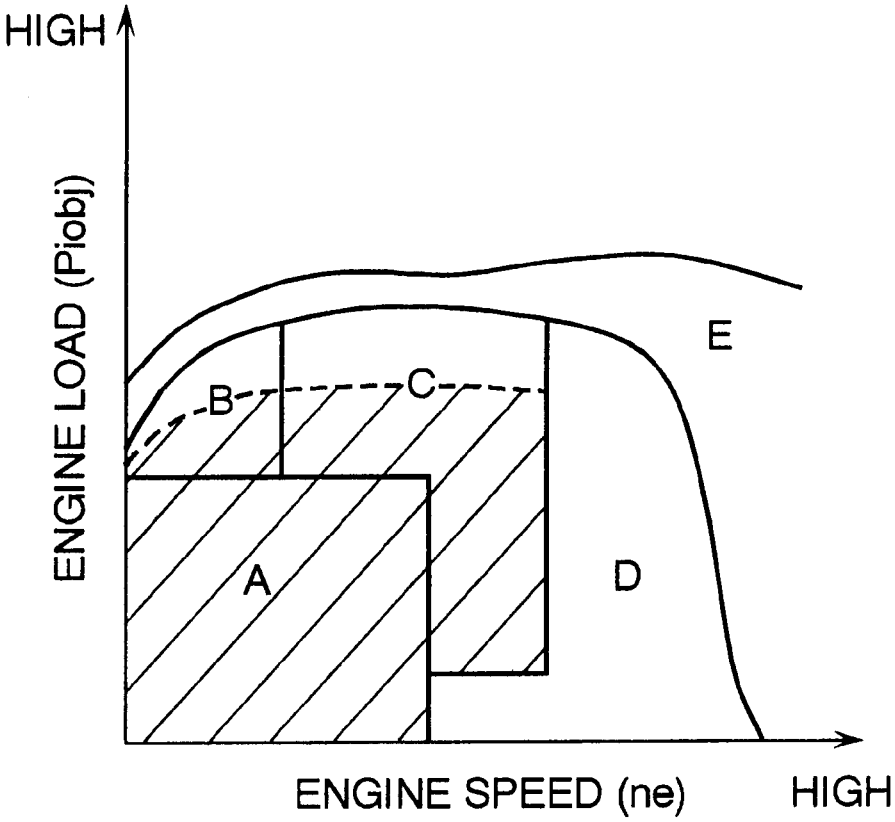
FIG. 4 is a control map of engine operating zone for combustion modes, namely a stratified charge combustion mode, a stoichiometric charge combustion mode and an enriched charge combustion mode.
Figure 5:
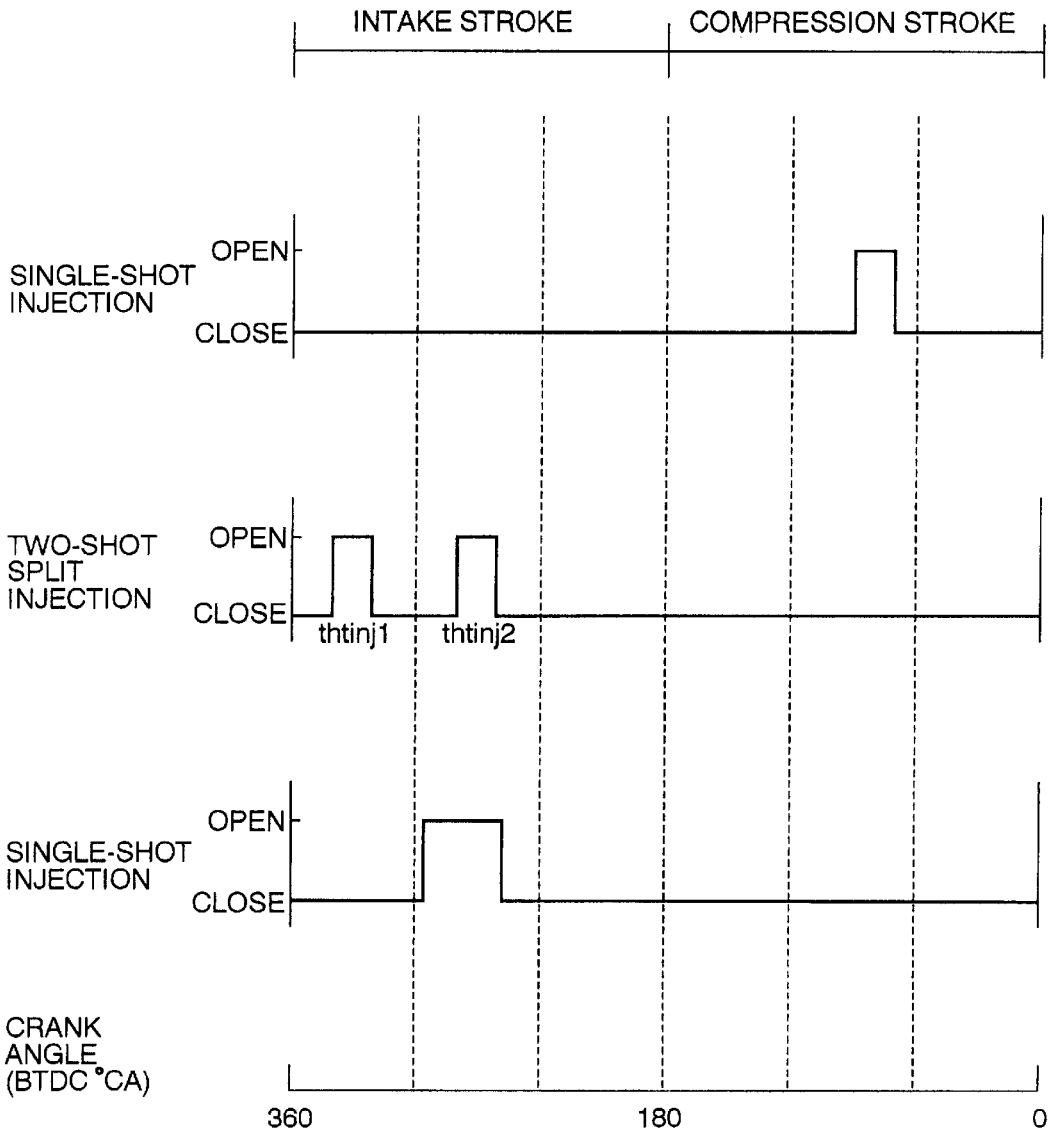
FIG. 5 is a time chart of fuel injection timing control.

Referring to FIG. 4 which shows engine operating regions for various combustion modes by way of example, engine operating conditions are divided into a region (A) for stratified charge combustion and regions (B), (C), (D) and (E) for homogeneous charge combustion. In the stratified charge combustion region (A) for lower engine loads and speeds after warming up, as shown in FIG. 5, the fuel injector 12 is controlled to perform a blanket fuel injection (a) in which fuel is sprayed in one lump after a mid-point of a compression stroke with an effect of unevenly distributing a fuel mixture near the spark plug 11 so as to cause the engine 1 to operate in a stratified charge combustion mode. In the stratified charge combustion mode, the throttle valve 22 and the EGR valve 34 are controlled to open large so as to lower a pumping loss of the engine 1 and admit a large amount of exhaust gas, respectively, as will be described later, as a result of which a mean air-fuel ratio in the combustion chamber 6 (which is hereafter referred to as a mean combustion chamber air-fuel ratio) is controlled to be on a very lean side. For example, while the engine 1 is in an idling state, the mean combustion chamber air-fuel ratio A/F is approximately 3.5. In the homogeneous charge as shown in FIG. 5, the fuel injector 12 is controlled to perform a split fuel injection (b) or a blanket fuel injection (c) in an intake stroke with an effect of mixing fuel sufficiently with air and evenly distributing the fuel mixture in the combustion chamber 6 so as to cause the engine 1 to operate in a homogeneous charge combustion mode. In the homogeneous charge combustion regions (B), (C) and (D), the amount of fuel injection and throttle opening are controlled so as to provide a mean combustion chamber air-fuel ratio approximately equal to a stoichiometric air-fuel ratio A/F of 14.7 or an excess air ratio γ of 1 (one). In this sense, the homogeneous charge combustion mode which is established in the homogeneous charge combustion regions (B), (C) and (D) is otherwise called a stoichiometric charge combustion mode. In the homogeneous charge combustion region (C) for relatively moderate engine loads and speeds, the fuel injector 12 is controlled to perform a split fuel injection (b) in which fuel is divided into two parts and sprayed through early split fuel injection and later split fuel injection in an intake stroke with an effect of acceleration of mixing fuel with air, so as to cause well homogeneous charge combustion. In the homogeneous charge combustion region (E) for higher engine loads and speeds, a mean combustion chamber air-fuel ratio is controlled to be on a rich side from the stoichiometric air-fuel ratio so as to cause the engine 1 to provide higher output correspondingly to higher engine loads. In this sense, the homogeneous charge combustion mode which is established in the homogeneous charge combustion region (E) is otherwise called an enriched charge combustion mode. In the respective combustion modes, the fuel injector 12 opens at an injection timing controlled according to engine operating conditions. For example, in the stratified charge combustion mode, the fuel injection timing is controlled according primarily to the amount of fuel injection and an engine speed so that, while securing a time for which fuel sprayed in a compression stroke is atomized and evaporated, the atomized and evaporated fuel is stratified around the spark plug 11. On the other hand, when implementing blanket fuel injection for spraying fuel in one lump in the stoichiometric charge combustion mode or the enriched charge combustion mode, the fuel injection timing is controlled according primarily to the amount of fuel injection so as to complete the fuel injection before a mid-period of an intake stroke which is desirable for atomization, evaporation and diffusion of the fuel and efficient acceleration of mixing the atomized and evaporated fuel with air. Shaded in FIG. 5 is an engine operating region for implementation of exhaust gas recirculation by controlling the EGR valve 34 to admit partly exhaust gas into an intake air stream in the intake passage 20 through the EGR passage 33. Due tot he exhaust gas recirculation, the heat capacity of the combustion chamber 6 is increased, which restrains generation of NOx during combustion. In particular, in the homogeneous charge combustion region (C) for relatively moderate engine loads and speeds, because of improved stability of combustion owing to accelerated mixing of fuel with air which is achieved through the split fuel injection, a sufficient amount of exhaust gas is recirculated even though the engine operates with relatively higher engine loads. In this instance, while the engine is before warming up, the homogeneous charge combustion mode is applied in the entire engine operating region in order to secure the stability of combustion.

Figure 6:
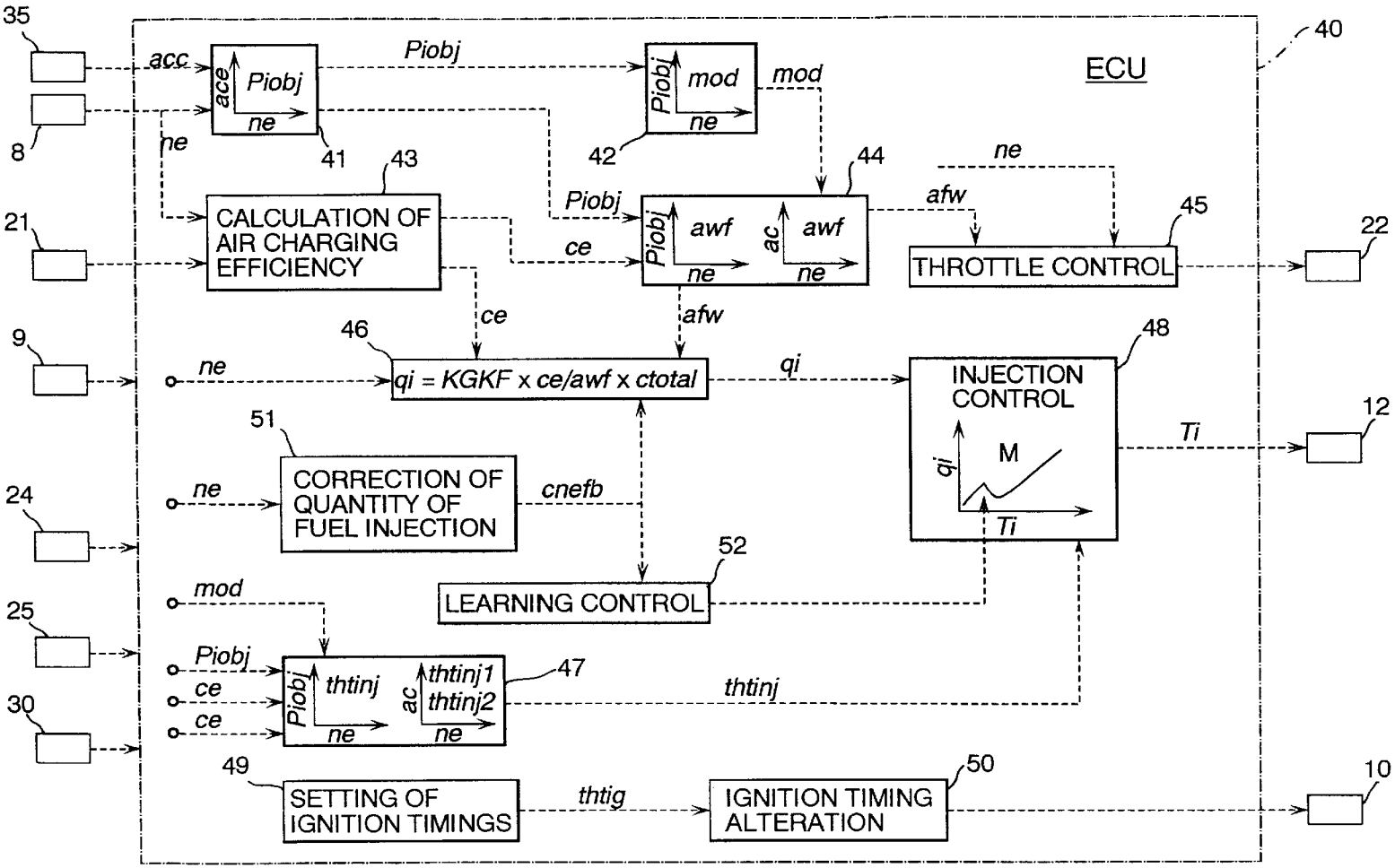
FIG. 6 is a functional block diagram showing a basic sequence of engine control.

FIG. 6 is a block diagram illustrating a basic function of the electric control unit 40 for engine control. As shown, the electric control unit 40 has various functional means 41 - 52. Target load operation means 41 operates a target engine load Piobj on the basis an engine speed ne which is determined from a crank angle signal from the crank angle sensor 8 and an accelerator travel acc which is detected by the accelerator travel sensor 35. The optimum target engine loads Piobj are experimentally predetermined for various accelerator travels and engine speeds and stored in the form of target load control map in a memory of the electric control unit 40. Combustion mode selection means 42 selects either one of the combustion modes correspondingly to the combustion region (A) (B), (C), (D) or (E) in which the engine speed ne. and the target engine load Piobj fall. Charging efficiency operation means 43 operates an intake air charging efficiency ce on the basis of an air flow rate which is determined from a signal from the air flow sensor 21 and the engine speed ne. Target air-fuel ratio operation means 44 operates a target air-fuel ratio afw on the basis of the intake air charging efficiency ce, the target engine load Piob, the engine speed ne and the selected combustion mode mod. The operation of intake air charging efficiency ce is calculated by dividing an amount of intake air detected by the air flow sensor 21 by the engine speed ne and then multiplying it by a specific coefficient. The optimum target air-fuel ratios afw are experimentally predetermined for each combustion mode and stored in the form of target air-fuel ratio control map in the memory of the electric control unit 40. Specifically, the optimum target air-fuel ratios afw for the stratified charge combustion mode are predetermined with respect to target engine loads Piobj and engine speeds ne. On the other hand, the optimum target air-fuel ratios afw for the homogeneous charge combustion mode are predetermined with respect to intake air charging efficiency ce and engine speeds ne. In the stoichiometric charge combustion mode, the stoichiometric air-fuel ratio (A/F =14.7) is used as a target value. The amount of fuel injection that is sprayed through the fuel injector 12 and the valve lift of the throttle valve 22 are controlled according to the target air-fuel ratio afw. Specifically, throttle control means 45 determines a target throttle valve lift on the basis of the target air-fuel ratio afw and the engine speed ne and provides a control signal representative of the target throttle valve lift with which a drive motor is actuated to operate the throttle valve 22 until attaining the target valve lift. Because the relationship of valve lift of the throttle valve to target air-fuel ratio afw and engine speed ne is different according to whether the exhaust gas recirculation is implemented or not, different maps of target valve lift are provided and selectively used according to implementation and non-implementation of the exhaust gas recirculation. Target fuel injection quantity operation means 45 operates target fuel injection quantity qi on the basis of the target air-fuel ratio afw, the intake air charging efficiency ce and the engine speed ne. The fuel injection quantity is given by the following equation:

$$qi=KGFK+(ce/afw) \times ctotal$$

where KGFK is a flow rate conversion coefficient which is well known in the art and ctotal is a general correction value. For example, letting cdpf, cfb, cnefb and celse be a feedback control value for the amount of fuel injection on the basis of fuel pressure and cylinder pressure (which is hereafter referred to as a pressure feedback control value), a feedback control value for the amount of fuel injection on the basis of an air-fuel ratio that is determined on the basis of a signal from the oxygen sensor 30 (which is hereafter referred to as an air-fuel ratio feedback control value), a feedback control value for the amount of fuel injection on the basis of an engine speed that is determined on the basis of a signal from the crank angle sensor 8 (which is hereafter referred to as an engine speed feedback control value) and a correction value according to engine operating conditions including cooling water temperature, the general correction value ctotal is given by the following equation:

$$ctotal=cdpf \times (1+cfb+cnefb+celse)$$

As apparent from the equation of the target fuel injection quantity qi, since the air-fuel ratio feedback control value cfb is determined on the basis of a signal from the oxygen sensor 30 while the engine 1 operates in the stoichiometric charge combustion mode, the target fuel injection quantity qi is feedback controlled to provide a stoichiometric mixture. On the other hand, since the air-fuel ratio feedback control value cfb is determined to be 0 (zero) while the engine 1 operates in the stratified charge combustion mode, the fuel injection quantity qi is ordinarily feedforward controlled. In this instance, while the engine 1 is in an idling state, the engine speed feedback control value cnefb is determined on the basis of a signal from the oxygen sensor 30, and then the fuel injection quantity qi is feedback controlled so as to bring the engine speed ne into a specified idling speed. Fuel injection timing control means 47 determines a fuel injection timing thtinj on the basis of the target engine loads Piobj, the engine speeds ne, the intake air charging efficiency ce and the selected combustion mode mod. The optimum fuel injection timings thtinj are experimentally predetermined for each combustion mode and stored in the form of fuel injection timing control map in the memory of the electric control unit 40. Specifically, the optimum fuel injection timings thtinj for the stratified charge combustion mode are predetermined with respect to target engine loads Piobj and engine speeds ne. On the other hand, the optimum fuel injection timings thtinj for the homogeneous charge combustion mode are predetermined with respect to intake air charging efficiency ce and engine speeds ne. For purposes of convenience two fuel injection timings thtinj1 and thtinj2 are determined in spite of the split fuel injection or the blanket fuel injection in the homogeneous charge combustion mode, and the fuel injector 12 is actuated but not spray fuel at the second fuel injection timing. When the target amount of fuel injection qi and the timing thtinj of fuel injection are determined, fuel injection control means 47 reads and determines an injection pulse width Ti, which is a measurement of how long the fuel injector 12 is kept open, for the target amount of fuel injection qi from a fuel injection amount control map M. When it is monitored on the basis of a crank angle signal from the crank angle sensor 8 that the timing of fuel injection thtinj is reached, the fuel injector 12 is actuated by a pulse signal having the injection pulse width Ti to spray the target amount of fuel injection qi. The electric control unit 40 further has ignition timing determination means 49 and ignition timing control means 50 as ignition control means. The ignition timing determination means 49 determines a basic ignition timing basic to a selected combustion mode mod and various correction values and determines an ignition timing thtinj based on the basic ignition timing and the correction values. The basic ignition timing for the stratified charge combustion mode is predetermined with respect to target engine loads Piobj and engine speeds ne and stored in the form of ignition timing control map. Similarly, the basic ignition timing for the homogeneous charge combustion mode is predetermined with respect to intake air charging efficiency ce and engine speeds ne and stored in the form of ignition timing control map. Further, the basic ignition timing for the split fuel injection is predetermined with respect to target air-fuel ratios afw and stored in the form of lookup table. The ignition timing control means 50 provides the ignition circuit 10 with a control signal to cause the spark plug 11 to produce a spark that ignites an air-fuel mixture. The electric control unit 40 is characterized by having fuel injection correction means 51 and flow characteristic learning control means 52. The fuel injection correction means 51 calculates an engine speed feedback control value cnefb for feedback controlling the amount of fuel injection on the basis of a crank angle signal from the crank angle sensor 8 so as to bring an engine speed ne into an idling speed while the engine 1 is in an idling state. The flow characteristic learning control means 52 learns practical quantitative variations in fuel injection that is sprayed through the fuel injector 12 from the target amount of fuel injection qi on the basis of the engine speed feedback control value cnefb.

Figure 7:
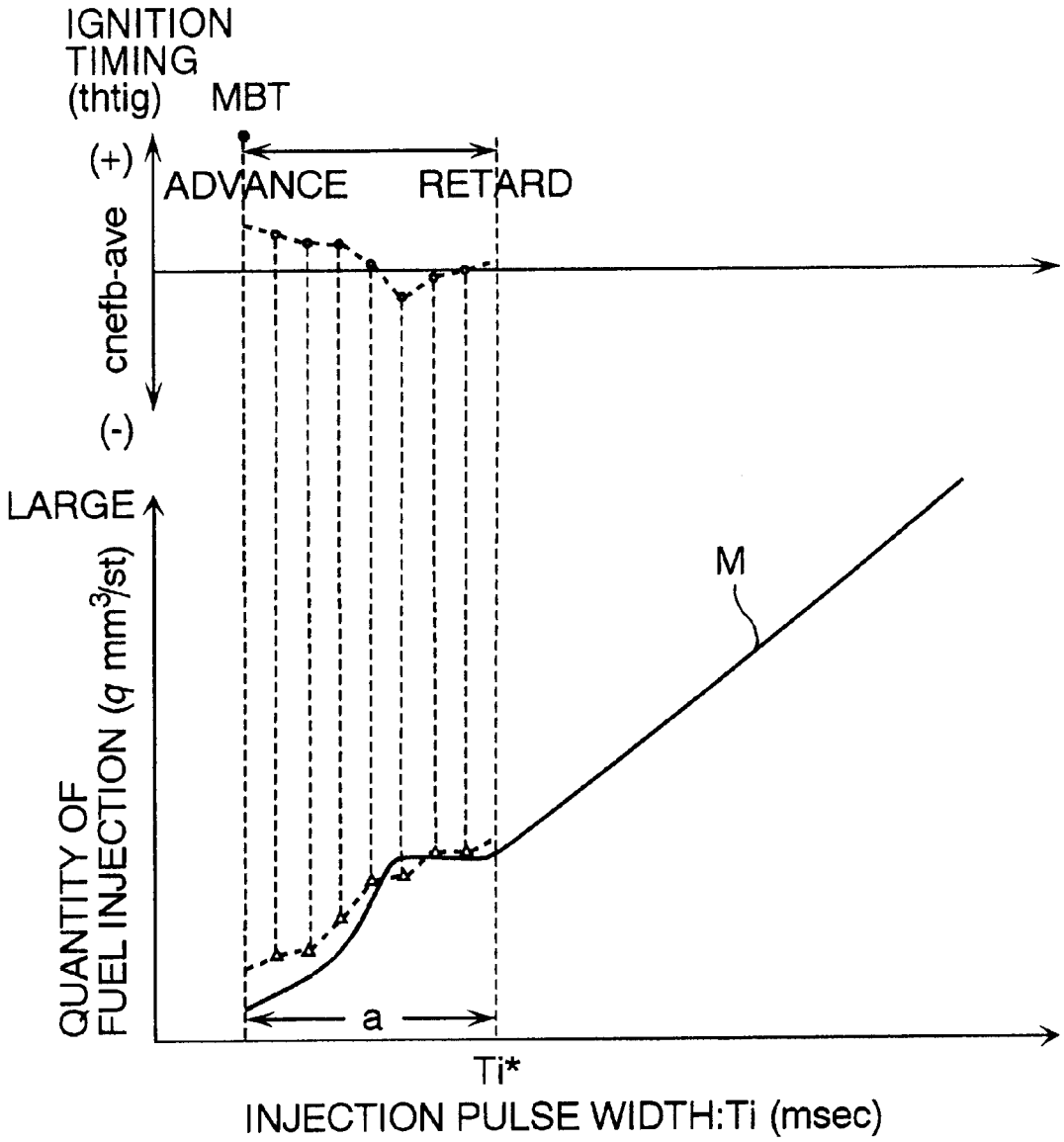
FIG. 7 is an explanatory diagram showing a micro-flow characteristic map of an injector for learning control.
Figure 8:
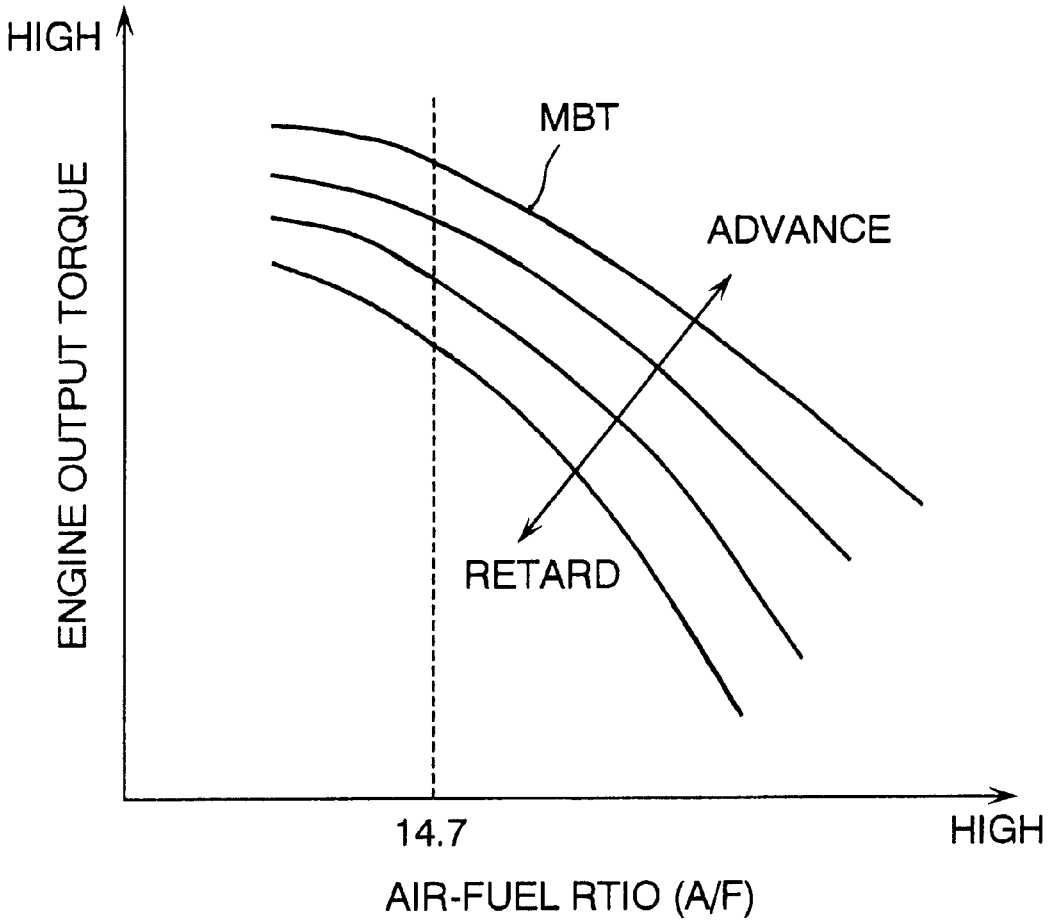
FIG. 8 is an explanatory diagram showing the relationship between air-fuel ratio and engine output for various spark timings.

The following is the leaning control of micro-flow characteristic of the fuel injector which is performed by the flow characteristic learning control means 52. In general, a fuel injector for a direct injection engine has the flow characteristic such as shown by a flow characteristic curve M in FIG. 7 by way of example. As shown, although the flow characteristic curve has a regular part in which the amount of fuel injection linearly changes relative to a change in injection pulse wide Ti in a region of injection pulse widths Ti equal to or greater than the specified pulse width Ti* and a fine and irregular part in a region of small injection pulse widths Ti smaller than the specified pulse width Ti* (small pulse width region "a") in which the amount of fuel injection does not change proportionally to a change in injection pulse width Ti and a change in the amount of fuel injection is irregular with respect to a change in injection pulse width Ti. The micro-flow characteristic is different among fuel injectors and, however, has high reproducibility. Since the fuel injector is actuated with injection pulses within the small pulse width region "a," it is preferred to learn and correct the micro-flow characteristic, i.e. the relationship between fuel injection quantity and injection pulse width, as precisely and finely as possibly in order to increase control accuracy of the amount of fuel injection of the fuel injector in the small pulse width region "a." Therefore, in this embodiment, the amount of fuel is feedback controlled so as to bring an engine speed of rotation ne into an idling engine speed of rotation while the engine is idling in the stratified charge combustion mode. The micro-flow characteristic leaning control is performed on the basis of an engine speed feedback control value cnefb for the fuel injection control. Specifically, in general, in the stratified charge combustion mode, the larger a change in engine output torque relative to a change in the amount of fuel injection in the stratified charge combustion mode is and the more an air-fuel ratio in the combustion chamber becomes on the lean side as shown, for example, in FIG. 8, the larger a change rate of engine output torque relative to a change in air-fuel ratio, i.e. a quantitative variation in fuel injection, is. For this reason, considerable variations in engine speed of rotation occur due to quantitative variations in fuel injection while the engine is idling. Accordingly, when feedback controlling the amount of fuel injection so as to provide an approximately constant engine speed of rotation ne, quantitative variations in fuel injection can be precisely detected on the basis of an engine speed feedback control value cnefb. Further, in this embodiment, the flow characteristic learning control is implemented for first to n-th predetermined ignition timings which are reached one after another by gradually retarding ignition from, for example, a timing for minimum advance for best torque (MBT). Specifically, since, when retarding ignition, the engine output drops as shown in FIG. 8, the speed feedback control for the amount of fuel injection is implemented according to the drop in engine output torque so as to increase the injection pulse width Ti. Therefore, by implementing the flow characteristic learning control for the respective predetermined ignition timing, a quantitative variation in fuel injection is learned for a plurality of, for example seven in this embodiment, injection pulse widths Ti which are different little by little from one another in the small pulse width region "a" as indicated by circles in FIG. 7.

As shown in FIG. 8, the more the ignition timing is advanced on the retarded side from the timing for minimum advance for best torque (MBT), the larger the engine output torque is. On the other hand, the more the ignition timing is retarded, the smaller the engine output torque is. The change rate of engine output torque is different according to air-fuel ratios in the combustion chamber, the more the air-fuel ratio is on the lean side, the larger the change rate of engine output torque with respect to a change in ignition timing becomes. Accordingly, in an event, such as idling, where the amount of fuel injection is fine, even if a width of changes in ignition timing for proper ignition of stratified charge of a fuel mixture is limited, it is possible to learn quantitative variations in fuel injection over a relatively wide region of injection pulse widths Ti. Mean air-fuel ratio in the combustion chamber represented by an excess air ratio (X) that can attain the above effects is preferably equal to or greater than 1.3. Since, when the mean air-fuel ratio (A/F) is 35 like in this embodiment while the engine is idling, the excess air ratio ($\gamma$) is approximately 2.3, which is sufficiently high. As is well known in the art, it is general to set an ignition timing on a retarded side from the timing for minimum advance for best torque (MBT) for the purposes of preventing miss firing. As described above, when finely learning quantitative variations in fuel injection for the respective injection pulse widths Ti in the small pulse width region "a" for which the micro-flow characteristic is applied, the flow characteristic curve M can be precisely corrected on the basis of learned values. That is, as shown, for example, in FIG. 7, a corrected flow characteristic curve can be obtained by plotting amounts of fuel injection (indicated by triangle) for the respective pulse widths Ti against which the seven learned values (shown by circles) in the small pulse width region "a" are matched off and connecting them as shown by a chained line.

Figure 9:
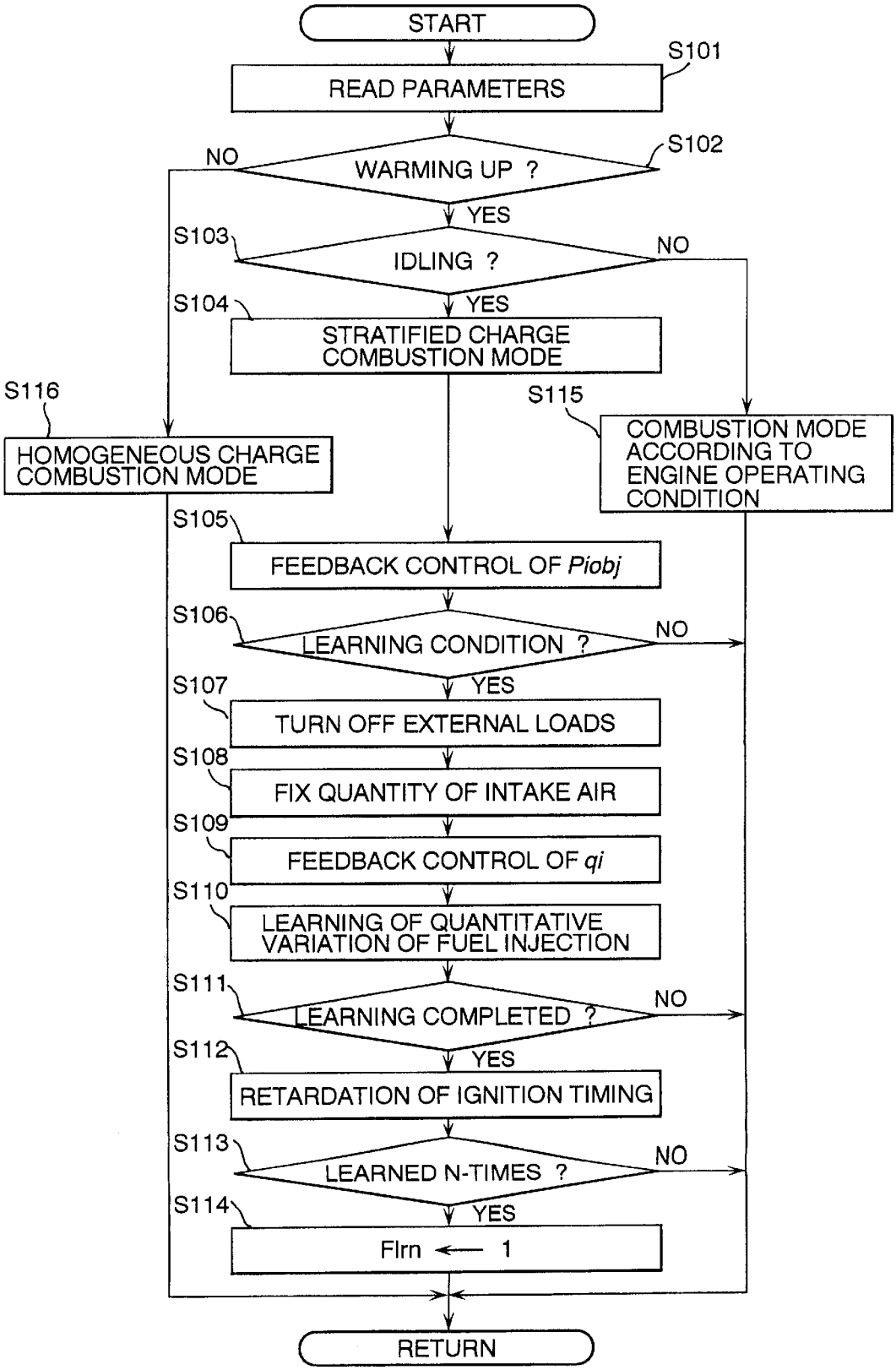
FIG. 9 is a flow chart illustrating a sequence routine of learning control.

FIG. 9 is a flow chart illustrating a sequence routine of flow characteristic learning control that was described above. When the flow chart logic commences and control proceeds to a function block at step S 101 where signals from various sensors and data in the memory are read in. The signals includes at least a signal from the crank angle sensor 8, a signal from the temperature sensor 9, a signal from the air flow sensor 21 and a signal from the accelerator travel sensor 35. Subsequently, a decision is made at step S102 as to whether the engine is warmed up. This decision is made on the basis of the temperature of engine cooling water. For example, when the engine cooling water is at a temperature higher than, for example, approximately 80° C., the engine 1 is decided to be warmed up. When the engine is warmed up, another decision is made at step S103 as to whether the engine is idling. This decision is made on the basis of an accelerator travel acc and an engine speed ne. When the engine is idling, after setting the stratified charge combustion mode at step S104, the feedback control is implemented according to the engine speed ne for a correction of target engine load Piobj at step S105. Then, a decision is made at step S106 as to whether specified condition for implementation of the flow characteristic learning control (flow characteristic learning condition) is satisfied. For example, the flow characteristic learning condition is satisfied in the event where the ignition timing is advanced to the first predetermined ignition timing. It may be additionally decided for satisfaction of the flow characteristic learning condition whether a learning completion flag Flrn is reset down to a state of 0. The learning completion flag Flrn indicates that the flow characteristic learning control is completed when it is reset down to "0" or that the flow characteristic learning control is still under implementation when it is set up to a state of "1." When the flow characteristic learning condition is unsatisfied, then, the flow chart logic returns to implement another sequence routine. On the other hand, when the flow characteristic learning condition is satisfied, after forcing appliances such as, for example, a compressor of an air conditioning system as an external engine load to turn off at step S107 and keeping the throttle valve 22 so as to admit a constant amount of intake air into the combustion chamber 6 at step S108, the feedback control is implemented according to the engine speed ne for a correction of the target amount of fuel injection qit for the respective fuel injector 12 at step S109. That is, the target amount of fuel injection qi is calculated using an engine speed feedback control value a cnefb for correcting the amount of fuel injection that is determined so as to decline a variation of the engine speed ne from a target idling engine speed is calculated.

Thereafter, quantitative variations in fuel injection by the respective fuel injector 12 are learned on the basis of the engine speed feedback control value cnefb at step S110. Specifically, a mean value cnefb#ave of engine speed feedback control values cnefb for m-times of combustion cycles is calculated as a learned value that indicates a quantitative variation in fuel injection. Since this mean engine speed feedback control value cnefb#ave is a value on which a characteristic of quantitative variation in of fuel injection is reflected, the practical amount of fuel injection is, on one hand, smaller than the target amount of fuel injection qi as long as the learned value, namely the mean engine speed feedback control value cnefb#ave, is accurate and, on the other hand, larger than that when the learned value takes a negative value. Subsequently, a decision is made at step S111 as to whether learning is achieved for the first predetermined ignition timing, in other words whether the calculation of a mean engine speed feedback control value cnefb#ave is achieved for the first predetermined ignition timing. When learning is not yet achieved, then, the flow chart logic returns to implement another sequence routine. On the other hand, when learning is achieved, after changing the ignition timing by a specified retardation, i.e. retarding the ignition timing to the second predetermined ignition timing, at step S112, a decision is made at step S113 as to whether learning is achieved for all of the first to n-th predetermined ignition timings. When learning is not yet achieved for the first to n-th predetermined ignition timings, then, the flow chart logic returns to implement another sequence routine. On the other hand, when learning is achieved for the first to n-th predetermined ignition timings, after setting up the learning completion flag Flrn at step S114, the flow chart logic returns to implement another sequence routine.

That is to say, when the engine is idling after warming up and the learning condition satisfied, the flow characteristic learning control is performed on the basis of the engine speed feedback control value cnefb for a correction of the amount of fuel injection for the first to n-th predetermined ignition timings for the injection pulse widths Ti in the small pulse width region "a" by gradually retarding the ignition timing while controlling the amount of intake air so as to keep constant by forcing the appliances as an external engine load to turn off and feedback controlling the amount of fuel injection so as to make the engine speed ne approximately constant.

When the engine is before warming up at step S102, after setting the engine 1 to the homogeneous charge combustion mode for the purpose of giving combustion stability the highest priority at step S116, the flow chart logic returns to implement another sequence routine. Further, when the engine is not idling at step S103, after setting the engine 1 to a combustion mode suitable for engine operating conditions such as an accelerator travel acc and an engine speed ne. at step S115 the flow chart logic returns to implement another sequence routine.

In place of obtaining a mean value of engine speed feedback control values cnefb for a number of combustion cycles as a learned value for a quantitative variation in fuel injection, a leaned value may be corrected on the basis of air charging efficiency ce that is calculated in the charging efficiency operation means 43. In general, the amount of fuel injection is feedback controlled to be slightly on the large side due to an increase in engine output torque when air charging efficiency ce is high and, on the other hand, to be slightly on the small side due to a decrease in engine output torque when air charging efficiency ce is low. Therefore, the accuracy of learning is more increased by correcting the learned value, i.e. the mean engine speed feedback control value cnefb#ave, on the basis of the air charging efficiency ce. Further, although the feedback control of the amount of fuel injection on the basis of engine speed and the learning control of flow characteristic are implemented by each fuel injector in the above embodiment, they may be implemented once for all of the fuel injectors 12.

In the flow chart logic, step S111 forms the flow characteristic learning control means 52 which learns practical quantitative variations in fuel injection that is sprayed through the fuel injector 12 while the engine 1 is in the stratified charge combustion mode during idling, and step S107 forms external load control means which forces appliances such as, for example, a compressor of an air conditioning system, as external an engine load to turn off when the flow characteristic learning control is implemented. Further, step S108 corresponds to the sequence performed by the throttle control means 45 in which the throttle valve 22 is controlled so as to supply an approximately constant amount of intake air into the combustion chamber 6 when the flow characteristic learning control is implemented. The throttle control means 45 performs control of the amount of intake air that is introduced into the combustion chamber 6 so as to make a mean combustion chamber air-fuel ratio represented by an excess air ratio γ equal to or greater than 1.3. Further, step S109 corresponds to the sequence performed by the fuel injection correction means 51 in which the amount of fuel injection through the fuel injector 12 is feedback controlled so as to bring an engine speed ne into an idling engine speed while when the flow characteristic learning control is implemented. Step S112 corresponds to the sequence performed by the and ignition timing control means 50 in which an ignition timing is changed so as to reach the predetermined ignition timings in turn. The flow characteristic learning control means 52 is configured and adapted to learn quantitative variations in fuel injection on the basis of the engine speed feedback control values cnefb, that is calculated by the fuel injection correction means 51, at the respective predetermined ignition timings.

Therefore, because, while feedback controlling the amount of fuel injection of the fuel injector 12 so as to make an engine speed ne constant, the fuel injection control system A for a direct injection-spark ignition engine in accordance with the above embodiment performs learning quantitative variations in fuel injection on the basis of the engine speed feedback control values cnefb during idling after warming up, practical quantitative variations in fuel injection are learned while the engine 1 operates in the small pulse width region "a". That is, because, while the engine operates in the stratified charge combustion mode likely during ordinarily idling, quantitative variations in fuel injection at the time is directly learned, the control o fuel injection is achieved with a significantly high precision during idling by correcting the flow characteristic curve on the basis of the learned result. In addition, because the engine 1 is prevented from changing its operating condition while implementing the flow characteristic learning control by forcing the appliances as an external engine load to turn off and fixing the amount of intake air constant, the flow characteristic learning control is performed with a sufficiently high precision. In this state, quantitative variations in fuel injection are precisely learned in the small pulse width region "a" for the micro-flow characteristic by forcibly changing the injection pulse width Ti so as to accord to a retardation from a timing for minimum advance for best torque (MBT). In other words, even in the small pulse width region "a" where the amount of fuel injection changes nonlinearly relative to a change in injection pulse width Ti and quantitative variations in fuel injection due to individual differences between fuel injectors are especially large, the correlation between the amount of fuel injection and pulse width is precisely learned. Quantitative variations in fuel injection can be eliminated in the state of idling where variations in fuel injection are apt to be great by correcting the flow characteristic curve of the fuel injector 12 for the micro-flow pulse width region "a" on the basis of the precise result of learning, so that the accuracy of the fuel injection control is improved much higher than it used to be. As a result, fuel consumption and emission levels are greatly lowered. Further, even during a transient engine operation in which a fine amount of fuel injection is required to be precisely controlled such as, for example, when resuming fuel injection following termination of the fuel-cut control, the accuracy of the fuel injection control is greatly improved. This improves drivability and further lowers fuel consumption and emission levels.

Figure 10A:
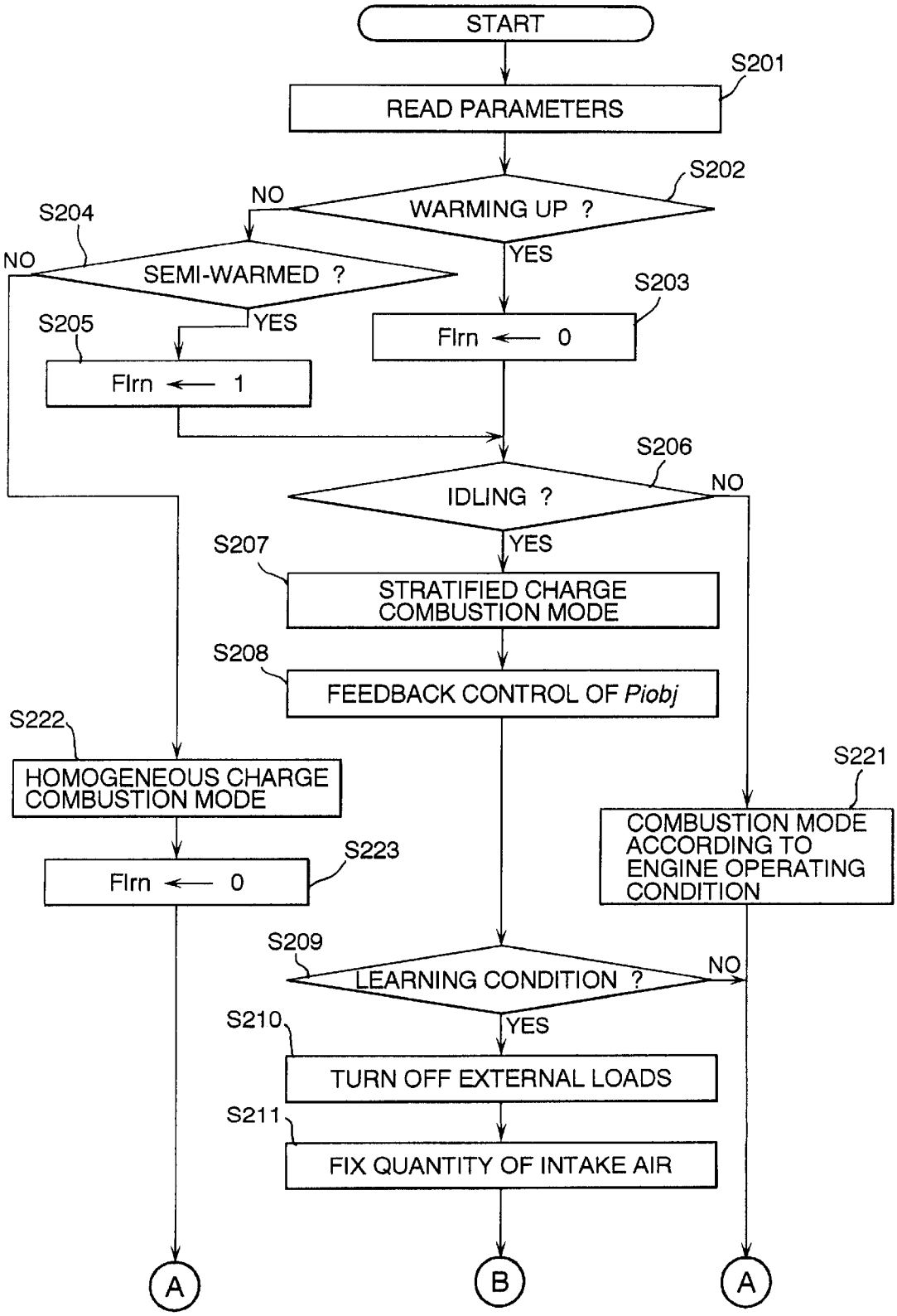
FIGS. 10A and 10B are respective parts of a flow chart illustrating a variation of the sequence routine of learning control which is implemented during warming up an engine.
Figure 10B:
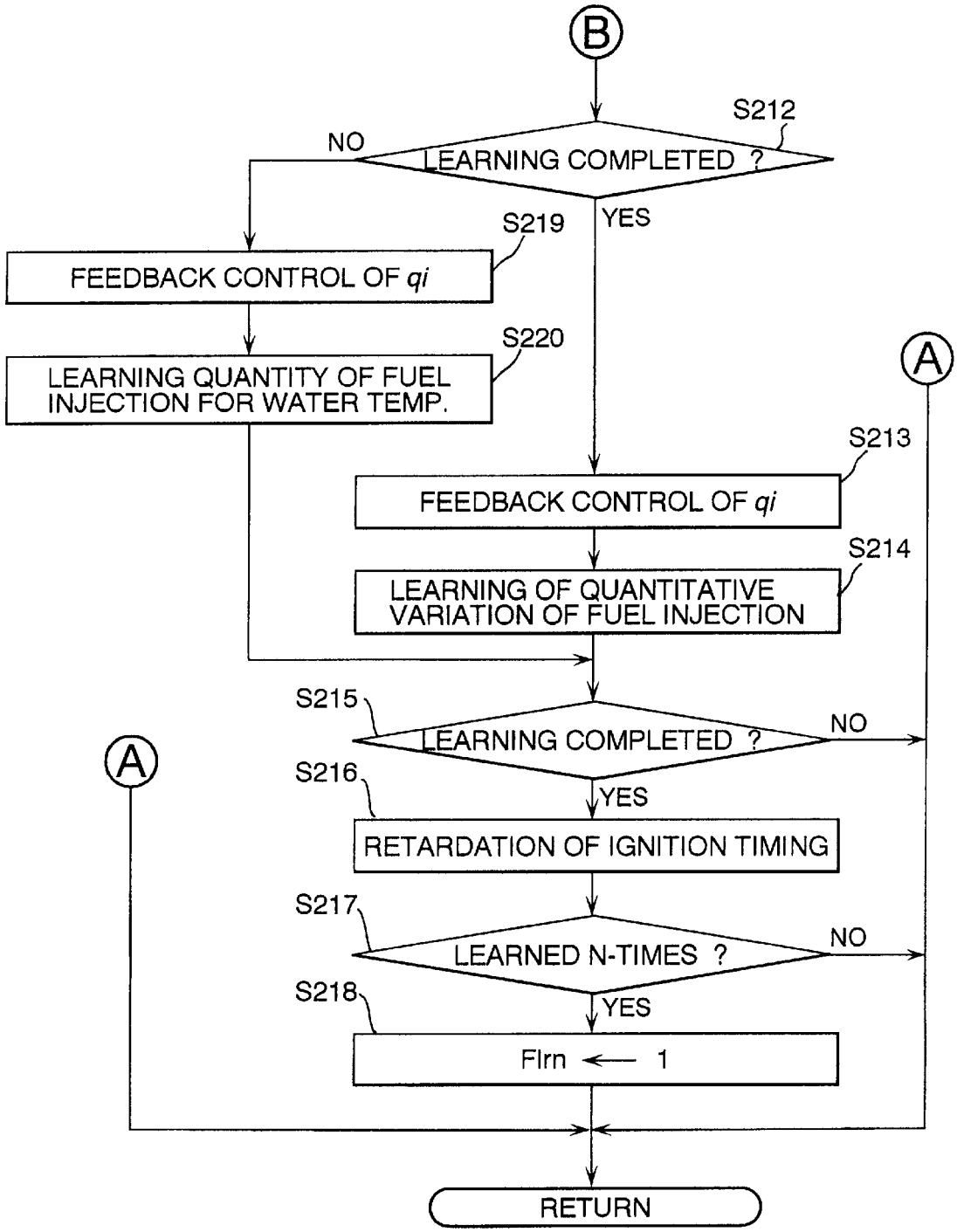

FIGS. 10A and 10B are respective parts of a flow chart illustrating a sequence routine of an variant of the flow characteristic learning control in which the flow characteristic learning is implemented in a semi-warmed state where the engine cooling water is at a somewhat high temperature as well as after warming up. As shown in FIG. 10, when flow chart logic commences and control proceeds to a function block at step S201 where signals from various sensors and data in the memory are read in. The signals includes at least a signal from the crank angle sensor 8, a signal from the temperature sensor 9, a signal from the air flow sensor 21 and a signal from the accelerator travel sensor 35. Subsequently, a decision is made at step S202 as to whether the engine is warmed up. This decision is made on the basis of the temperature of engine cooling water. When the engine is warmed up, after resetting down a semi-warmed flag Fi at step S203, another decision is made at step S206 as to whether the engine is idling. On the other hand, when the engine is not yet warmed up, a decision is made at step S204 as to whether the engine is semi-warmed. When the engine is semi-warmed, after setting up the semi-warmed flag Fi at step S205, the decision as to idling is made at step S206. When the engine is not yet semi-warmed, the flow chart logic proceeds to step S222. The engine is decided to be in a semi-warmed condition while the temperature of engine cooling water is less than, for example, 45° C.

When the engine is idling, after setting the stratified charge combustion mode at step S207, the feedback control is implemented according to the engine speed ne for a correction of target engine load Piobj at step S208. Then, a decision is made at step S209 as to whether a flow characteristic learning condition for implementation of the flow characteristic learning control is satisfied. When the flow characteristic learning condition is unsatisfied, then, the flow chart logic returns to implement another sequence routine. On the other hand, when the flow characteristic learning condition is satisfied, after forcing appliances as an external engine load to turn off at step S210 and keeping the throttle valve 22 so as to admit a constant amount of intake air into the combustion chamber 6 at step S211, a decision is made at step S212 as to whether the semi-warmed flag Fi is down. When the answer to the decision is YES, this indicates that the engine is warmed up, then, the feedback control is implemented according to the engine speed ne for a correction of the target amount of fuel injection qit for the respective fuel injector 12 at step S213. Thereafter, quantitative variations in fuel injection by the respective fuel injector 12 are learned on the basis of the engine speed feedback control value cnefb at step S214.

Figure 11:
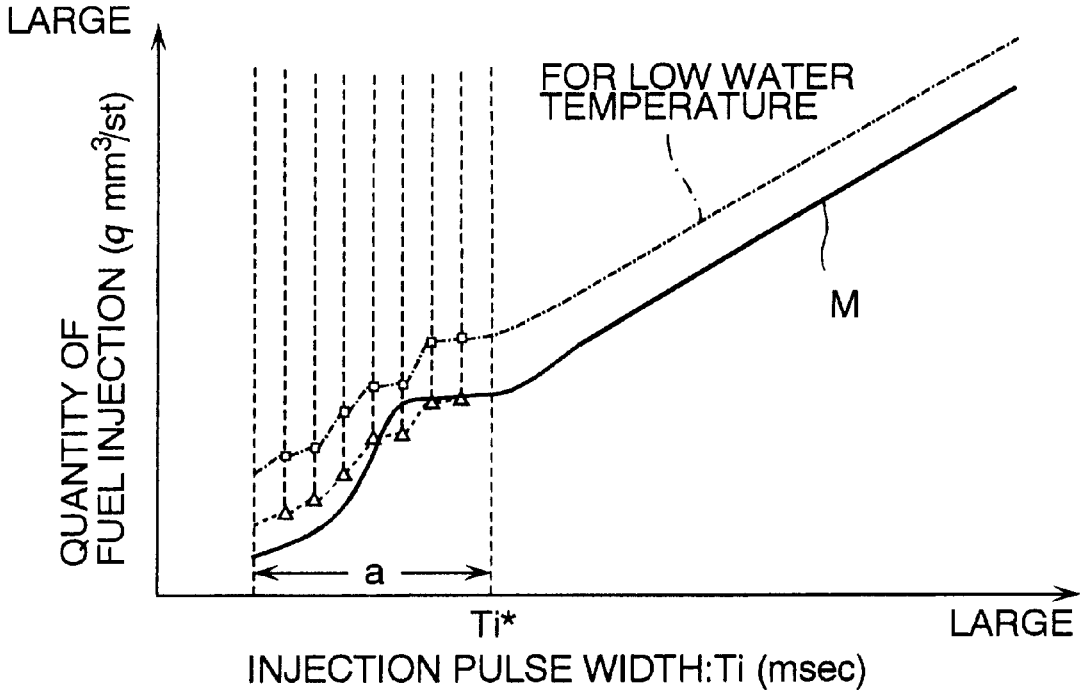
FIG. 11 is an explanatory diagram showing a micro-flow characteristic map of a fuel injector for learning control in accordance with another embodiment of the present invention.

On the other hand, when the answer to the decision is NO, this indicates that the engine is semi-warmed, then, after implementing the feedback control according to the engine speed ne for a correction of the target amount of fuel injection qit for the respective fuel injector 12 at step S219, quantitative variations in fuel injection by the respective fuel injector 12 are learned for the temperature of engine cooling water at step S220. Specifically, since, when the engine 1 is semi-warmed, a drop in engine output torque generally occurs due to a delay in atomization and evaporation of fuel in the combustion chamber 6, it is necessary to somewhat increase the amount of fuel injection in order to keep an idling engine speed. For this reason, the engine speed feedback control value cnefb is generally larger than after warming up, learned values shift upwards as shown by squares in FIG. 11. As a result, a flow characteristic curve Msemi after semi-warming (semi-warmed flow characteristic) corrected on the basis of the learned values generally shifts upwards from a flow characteristic curve M after warming up (warmed flow characteristic curve). In this instance, because the semi-warmed flow characteristic curve Msemi only shifts and the individual difference inherent in the fuel injector 12 is rightly reflected in the semi-warmed flow characteristic curve Msemi, an almost precise warmed flow characteristic curve M is gained by shifting the semi-warmed flow characteristic curve Msemi downward according to a temperature of engine cooling water. Therefore, in this embodiment, the learned value is corrected according to a current temperature of engine cooling water at step S220. In other words, the flow characteristic curve M shown in FIG. 7 is shifted downward so as to gain a learned value as one after warming up.

Subsequent to learning the quantitative variations in fuel injection on the basis of the engine speed feedback control value cnefb at step S214 or S220, a decision is made at step S215 as to whether learning is achieved for the first predetermined ignition timing, in other words whether the calculation of a mean engine speed feedback control value cnefb#ave is achieved for the first predetermined ignition timing. When learning is not yet achieved, then, the flow chart logic returns to implement another sequence routine. On the other hand, when learning is achieved, after changing the ignition timing by a specified retardation, i.e. retarding the ignition timing to the second predetermined ignition timing, at step S216, a decision is made at step S217 as to whether learning is achieved for all of the first to n-th predetermined ignition timings. When learning is not yet achieved for the first to n-th predetermined ignition timings, then, the flow chart logic returns to implement another sequence routine. On the other hand, when learning is achieved for the first to n-th predetermined ignition timings, after setting up the learning completion flag Flrn at step S218, the flow chart logic returns to implement another sequence routine.

In this embodiment shown in FIG. 10, the flow characteristic learning is implemented also while the engine is in a semi-warmed condition where the engine is often apt to be put in an idling state, the frequency in learning the quantitative variations in fuel injection is increased. Moreover, because the learned value is corrected according to the temperature of engine cooling water, an almost precise warmed flow characteristic curve M is gained on the basis of the learned value gained while the engine is in a semi-warmed state. In other words, the high precision fuel injection control is realized by shifting the warmed flow characteristic curve M early on the basis of a sufficiently precise learned value.

It is to be understood that although the present invention has been described in detail with respect to the preferred embodiments thereof, various other embodiments and variants may occur to those skilled in the art, which are within the scope and spirit of the invention, and such other embodiments and variants are intended to be covered by the following claims.

What is claimed is:

1. A fuel control system for a direct-injection spark-ignition type of engine which is equipped with a fuel injector for spraying fuel directly into a combustion chamber in a compression stroke so as to cause stratified charge combustion in a specified engine operating region of lower engine loads and lower engine speeds, said fuel injection control system comprising:

speed detection means for detecting a speed of rotation of said engine;

air-fuel ratio detection means for detecting as an air-fuel ratio representative of an actual quantity of fuel injection by said fuel injector;

intake air quantity regulation means for regulating a quantity of intake air that is admitted into said combustion chamber;

control means for calculating a target quantity of fuel injection on the basis of at least said engine speed learning a quantitative variation between said actual quantity of fuel injection and said target quantity of fuel injection when the engine is idling in said specified engine operating region, for controlling said intake air regulation means so as to provide a constant quantity of intake air that is admitted into said combustion chamber while learning said quantitative variation, and for performing feedback control of said actual quantity of fuel injection so as to bring said engine speed into a specified idling engine speed while learning said quantitative variation;

wherein said quantitative variation is learned on the basis of feedback control values in said feedback control for a plurality of specified fuel injection timings which take place in turn.

2. A fuel injection control system as defined in claim 1, wherein said control means calculates said target quantity of fuel injection according at least to an engine operating condition and controls said fuel injector to keep open for a period of time necessary for said target quantity of fuel injection according to a fuel injection characteristic of said fuel injector which represents a relationship between a quantity of fuel injection and a period of time for which said fuel injector keeps open, and wherein said control means corrects said fuel injection characteristic on the basis of said learned values for said plurality of said specified fuel injection timings.

3. A fuel injection control system as defined in claim 1, wherein said control means controls said intake air quantity regulation means to admit said intake air into said combustion chamber so as to provide a mean excess air ratio $\gamma$ equal to or greater than 1.3 while learning said quantitative variation.

4. A fuel injection control system as defined in claim 1, wherein said engine has a multiple cylinders, and said control means learns said quantitative variation on the basis of a mean value of said feedback control values in a specified combustion cycles by cylinder.

5. A fuel injection control system as defined in claim 1, wherein said control means further calculates a charging efficiency of said intake air admitted into said combustion chamber and corrects said learned value on the basis of said charging efficiency.

6. A fuel injection control system as defined claim 1, wherein said control means forces appliances as an external engine load on said engine to turn off.

7. A fuel injection control system as defined in claim 1, wherein said control means learns said quantitative variation after said engine warms up .

8. A fuel injection control system as defined in claim 1, wherein said control means learns said quantitative variation when engine cooling water is higher than a specified temperature even before said engine warms up.

9. A fuel injection control system as defined in claim 8, wherein said control means corrects said learned value according to a temperature of said engine cooling water.

10. A fuel injection control system for a direct-injection spark-ignition type of engine which is equipped with a fuel injector for spraying fuel directly into a combustion chamber in a compression stroke so as to cause stratified charge combustion in a specified engine operating region of lower engine loads and lower engine speeds, said fuel injection control system comprising:

an intake air flow sensor operative to detect a flow rate of intake air;

a regulation valve operative to regulate a quantity of intake air that is admitted into said combustion chamber;

a crank angle sensor operative to detect a rotational crank angle as a speed of rotation of said engine;

an O2 sensor disposed in an exhaust line to detect an oxygen concentration of an exhaust gas from said engine as an air-fuel ratio which represents an actual quantity of fuel injection by said fuel injector;

an electronic control unit operative to calculate a target quantity of fuel injection on the basis of at least said engine speed, to learn a quantitative variation between said actual quantity of fuel injection and said target quantity of fuel injection when the engine is idling in said specified engine operating region, to control said intake air regulation means so as to provide a constant quantity of intake air that is admitted into said combustion chamber while learning said quantitative variation, to control said fuel injector to keep open for a period of time necessary for said target quantity of fuel injection according to a fuel injection characteristic of said fuel injector which represents a relationship between a quantity of fuel injection and a period of time for which said fuel injector keeps open, and to perform feedback control of said actual quantity of fuel injection so as to bring said engine speed into a specified idling engine speed while learning said quantitative variation;

wherein said quantitative variation is learned on the basis of a feedback corrections value in said feedback control for a plurality of specified fuel injection timings which take place in turn and said fuel injection characteristic is corrected on the basis of said learned values for said plurality of said specified fuel injection timings.

11. A method of controlling fuel injection for a direct-injection spark-ignition type of engine which is equipped with a fuel injector for spraying fuel directly into a combustion chamber in a compression stroke so as to cause stratified charge combustion in a specified engine operating region of lower engine loads and lower engine speeds, said method of controlling fuel injection comprising the steps of:

calculating a target quantity of fuel injection according at least to an engine operating condition;

controlling said fuel injector to keep open for a period of time necessary for said target quantity of fuel injection according to a fuel injection characteristic of said fuel injector which represents a relationship between a quantity of fuel injection and a period of time for which said fuel injector keeps open; and providing a constant quantity of intake air that is admitted into said combustion chamber while rendering said engine idle in said specified engine operating region and performing feedback control of an actual quantity of fuel injection by said fuel injector so as to bring an engine speed into a specified idling engine speed while said engine idles in said specified engine operating region;

wherein a quantitative variation between said actual quantity of fuel injection and said target quantity of fuel injection is learned on the basis of a feedback corrections value in said feedback control for a plurality of specified fuel injection timings which take place in turn and said fuel injection characteristic is corrected on the basis of said learned values for said plurality of said specified fuel injection timings.

* * * * *